United States Patent [19]

Harris

[11] 3,946,098

[45] Mar. 23, 1976

[54] PREPARATION OF FEED MATERIAL FOR A BLAST FURNACE

[75] Inventor: Colin Frank Harris, Chipping Sodbury, near Bristol, England

[73] Assignees: Metallurgical Processes Ltd., Nassau, Bahamas; I.S.C. Smelting Limited (Metallurgical Development Company), London, England

[22] Filed: Dec. 11, 1973

[21] Appl. No.: 423,748

[30] Foreign Application Priority Data

Dec. 11, 1972 United Kingdom ..... 57093/72
May 30, 1973 United Kingdom ..... 25631/73

[52] U.S. Cl. ..... 264/117
[51] Int. Cl.[2] ..... B01J 2/12
[58] Field of Search ..... 264/117, 109

[56] References Cited

UNITED STATES PATENTS

| | | | |
|---|---|---|---|
| 3,231,649 | 1/1966 | Pfeiffer | 264/109 |
| 3,401,089 | 9/1968 | Friedrich et al. | 264/117 |
| 3,562,783 | 2/1971 | Gorin | 264/117 |
| 3,760,050 | 9/1973 | Blaker et al. | 264/117 |

OTHER PUBLICATIONS

Chemical Engineering Magazine, Dec. 4, 1967, McGraw-Hill Pub. Co., New York, pp. 154–157.

*Primary Examiner*—Robert F. White
*Assistant Examiner*—James R. Hall
*Attorney, Agent, or Firm*—Holman & Stern

[57] ABSTRACT

Producing a briquetted oxidic feed for a blast furnace by pelletizing very fine zinc oxide or zinc oxide and lead oxide powder into pellets having an average diameter of from 2 to 10 millimeters prior to briquetting the oxide pellets at a temperature of from 500° to 800°C and a pressure of from 1 to 20 tons/square inch.

8 Claims, No Drawings

PREPARATION OF FEED MATERIAL FOR A BLAST FURNACE

This invention relates to the preparation of feed material for a blast furnace for smelting zinc or zinc and lead, and in particular to the preparation of briquettes of zinc oxide or of zinc oxide and lead oxide suitable for feeding to a blast furnace.

British Patent Specification No. 1,302,864 describes and claims a process for preparing a lump oxidic charge for smelting in a blast furnace, the process comprising the successive steps of:

a. desulphurizing sulphidic raw material predominantly containing zinc values or lead values, or a mixture of zinc and lead values, and crushing, if necessary, particulate oxidic material; and b. compressing this particulate oxidic material at a pressure of between 1 and 20 tons/square inch and at a temperature of at least 500°C without the addition of a carbonaceous or other binder, to form the lump oxidic charge.

While this process works well for calcines, that is fine material produced by roasting zinc/lead sulphide ores in a suitable roasting apparatus (for example, a fluidized bed roaster), the process does not work at all well for the very fine zinc fume produced in a process such as the "Waelz kiln" process in which impure zinc/iron oxide solids are reduced with a carbonaceous reducing agent in a rotating kiln, with countercurrent flow of air to give a very fine suspension of zinc oxide which is collected in bag-filters.

This very fine zinc oxide is very difficult to handle and does not flow well when fed to a press such as a roll press for the production of briquettes. The result is that the oxide may pass through the press without briquettes being formed or indeed with insufficient densification to permit formation of briquettes on repressing.

I have now found that this very fine zinc oxide powder can be used to make good, reasonably strong briquettes provided that the powder is formed into substantially spherical pellets of from 2 to 10 millimeters diameter before being fed into the briquette-forming press.

Accordingly, the invention provides a process for producing a briquetted oxidic feed for a blast furnace, comprising the steps of:

a. pelletizing a very fine zinc oxide or zinc oxide and lead oxide powder into substantially spherical pellets having an average diameter of from 2 to 10 millimeters;

b. bringing the pellets to a temperature of from 500° to 800°C; and c. briquetting the oxide pellets at a temperature of from 500° to 800°C and a pressure of from 1 to 20 tons/square inch, without the addition of a binder, to form strong coherent briquettes suitable for feeding to a blast furnace.

The oxide feed is preferably predominantly zinc oxide although it may contain up to 50% by weight of lead oxide. If more lead oxide than this is present it may be necessary to modify the briquetting conditions. It should be understood that, in addition to lead oxide, the zinc oxide material may contain up to 25% total by weight of impurities such as cadmium oxide, calcium oxide, silica or iron oxide, although usually the material will not normally contain more than 10% by weight of such impurities.

Preferably the pelletizing step is carried out in an apparatus such as a disc-pelletizer or a drum-pelletizer. In such an apparatus fine powder and a spray of water are fed onto an inclined revolving disc or into a revolving hollow drum. As the disc or the drum revolves it carries some powder on its upwardly-moving surface and this powder is removed from the surface by means of a scraper-blade and falls back to the bottom of the disc or drum from where it is carried up again on the revolving surface. The continual rolling of the wet powder particles leads to agglomeration and hence to the formation of substantially spherical pellets. The pellets will then be heated to a temperature of from 500° to 800°C before carrying out the briquetting step.

Alternatively, the fine powder can be pelletized by passing it through a rotating heated kiln (known as a "nodulizing kiln") at a temperature of from 900° to 1300°C. The pellets will then be cooled to a temperature of from500° to 800°C before carrying out the briquetting step.

It is advantageous to add some finely-divided carbonaceous solid, for example coke breeze, to the zinc oxide or zinc oxide and lead oxide before briquetting to improve the fuel economy of the smelting process by reducing the amount of metallurgical coke which needs to be fed into the blast furnace with the briquettes. Such carbonaceous solids do not normally function as a binder but merely serve to introduce some carbon into the oxidic feed so as to reduce the amount of reducing agent which has to be added separately to the furnace.

It is believed that the improvement in briquette quality when pellets are formed prior to briquetting can be attributed to the fact that the pellets flow better and more completely fill the pockets in the roll press, but this is not certain. In general, it is preferable to form pellets of an average diameter of from 2 to 6 millimeters.

The method according to the invention has been successfully operated on the following raw materials:

1. Waelz oxide fume;

2. "Blue powder" produced by scrubbing the exit gases from the condenser of a zinc blast furnace; and

3. "Baghouse" oxide from a zinc oxide plant.

Of these, (1) and (3) are fairly pure zinc oxide containing relatively low impurity levels whereas (2) is a partially-metallic, partially oxidic zinc/lead material produced by water scrubbing the gases leaving the leadsplash condenser of a zinc blast furnace. More precise analyses of these materials are given in the Examples below.

Although the preferred starting material for the process of this invention is fine zinc oxide produced by the oxidation of zinc vapor it is possible to use other zinc oxides, for examples as produced by roasting zinc sulphide and grinding the product. The main criterion is that the zinc oxide is of such a nature that it does not flow freely into cavities such as the pockets of a briquetting press. Thus preferred starting materials are fine oxides produced by vapor-phase oxidation, for example, Waelz oxide or "Baghouse" oxide collected from a gas stream.

It is preferable for the pellets to be dried and brought to a temperature of at least 600°C before they are fed into the briquetting press. This is especially important where the moisture content of the pellets is high, as it will be after a drum pelletizing operation. The pellets are fed via a hopper to the roll press in the usual manner, and are pressed hot in the usual way to form coherent briquettes of good mechanical strength. Briquettes having a cold rattle strength (as hereinafter explained) of over 80% and a hot rattle strength (as hereinafter explained) over 90%, have been produced from both Waelz oxide and "Blue powder" using the technique according to the invention, with a briquetting temperature of about 700°C.

The invention will be further described with reference to the following examples.

EXAMPLE 1

German Waelz oxide of analysis 60.0% by weight Zn, 11.6% by weight Pb and 1.7% by weight S was fed as a fine powder, with water, onto a pelletizing disc and was formed into substantially spherical pellets of from 2 to 6 mm. average diameter. These pellets were heated to 825°C in a pre-heating kiln situated abovea roll press and were fed via a hopper and a scroll-feeder to pockets in a roll press, and the pellets, having been brought to a temperature of 650°C, were briquetted at that temperature and at a pressure of 3000 lbs per square inch. The dimensions of the pockets were 31 mm by 21 mm, the volume being approximately 6.5 mls. The resulting briquettes had a cold rattle strength of 87%, a hot rattle strength of 95%, a bulk density of 4.67 gms/ml and an apparent porosity of 13.5%.

EXAMPLE 2

"Baghouse" zinc oxide of analysis 80% by weight zinc as oxide was formed into substantially spherical pellets of from 2 to 6 mm average diameter as in Example 1. These pellets were heated in a kiln to 800°C, and then, having been brought to a temperature of 660°C, were briquetted at that temperature and at a pressure of 3000 lbs. per square inch in a roll press having dimensions as set out in Example 1. The resulting briquettes had a hot rattle strength of 95%, a cold rattle strength of 77%, a bulk density of 4.51 grms/ml and an apparent porosity of 19.6%.

EXAMPLE 3

40% by weight of "Blue powder" of analysis 33.9% by weight Zn, 30.9% by weight Pb and 5.3% by weight S and 60% by weight of "Baghouse" oxide containing 80% by weight zinc were mixed and fed, with water, onto a pelletizing disc and formed into substantially spherical pellets of greater than 2mm average diameter. These pellets were heated in a kiln to 800°C, and, having been brought to a temperature of 670°C, were briquetted at that temperature and at a pressure of 3000 lbs. per square inch in a roll press having dimensions as set out in Example 1. The resulting briquettes had a cold rattle strength of 92%, a hot rattle strength of 99%, a bulk density of 4.98 gms/ml and an apparent porosity of 10.6%

EXAMPLE 4

Polish Waelz oxide of analysis 46% by weight Zn, 8% by weight Pb, 6% by weight Fe, 2.6% by weight S, 6% by weight CaO and 6.3% by weight $SiO_2$ was pelletized into substantially spherical pellets of from 2 to 6 mm average diameter, preheated in a kiln to 845°C, and, having been brought to a temperature of 750°C, were briquetted at that temperature and at a pressure of 3000 lbs. per square inch. The resulting briquettes had a cold rattle strength of 84%, a bulk density of 3.79 gms/ml, and an apparent porosity of 19.1%.

The cold rattle index and the hot rattle index tests referred to above were carried out as follows.

COLD RATTLE INDEX TEST

This test was carried out on a 1000 gms sample at room temperature in a 165 mm diameter steel drum fitted with 25 mm lifter bars, rotating at 75 rpm for 6 minutes. Prior to testing any easily removable flash attached to the briquettes was knocked off. The proportion off the sample, expressed as a percentage, which after rattling did not pass through a 12.5 mm screen was taken as the cold rattle strength index. ISF sinter is normally regarded as being of acceptable strength if it gives a cold rattle strength of over 80%.

HOT RATTLE INDEX TEST

The + 12.5 mm fraction from the cold rattle index test was inserted into a 150 mm diameter carborundum drum fitted with two 25 mm lifter bars which had been electrically heated to a temperature of 1000°C. The temperature in the drum was brought back up to 1000°C (normally taking about 10 minutes). The drum was then rotated at 90 rpm for 6 minutes. The proportion of the sample expressed as a percentage, which after rattling did not pass through a 12.5 mm screen was taken as the hot rattle strength index.

I claim:

1. In a process for producing a briquetted oxidic feed for a blast furnace comprising briquetting an oxidic material selected from the group consisting of zinc oxide powder and zinc oxide and lead oxide powder at a temperature of from 500° to 800°C and a pressure of from 1 to 20 tons/square inch, without the addition of a binder, to form coherent briquettes suitable for feeding to a blast furnace, the improvement comprising the steps of:

a. pelletizing the oxidic material powder of a fineness insufficient to form coherent briquettes suitable for feeding to a blast furnace into substantially spherical pellets having an average diameter of from 2 to 10 millimeters; and b. heating the pellets to a temperature of from 500°C. to 800°C prior to the briquetting step.

2. The process as claimed in claim 1 wherein the oxidic material comprises up to 50% by weight of lead oxide.

3. The process as claimed in claim 1 wherein step (a) comprises feeding the oxidic material and a spray of water onto a revolving surface whereby the continual rolling of the wet powder particles leads to agglomeration of the particles and to the formation of substantially spherical pellets.

4. The process as claimed in claim 3 further comprising drying the pellets formed in step (a) prior to step (b).

5. The process as claimed in claim 1 further comprising adding a finely-divided carbonaceous solid to the oxidic material pellets formed in step (a) before step (b).

6. The process as claimed in claim 5 wherein the carbonaceous solid is coke breeze.

7. The process as claimed in claim 1 wherein the pellets formed in step (a) have an average diameter of from 2 to 6 millimeters.

8. In a process for producing a briquetted oxidic feed for a blast furnace comprising briquetting an oxidic material selected from the group consisting of zinc oxide powder and zinc oxide and lead oxide powder at a temperature of from 500°C to 800°C and a pressure of from 1 to 20 tons/square inch, without the addition of a binder, to form coherent briquettes suitable for feeding to a blast furnace, the improvement comprising the steps of:

a. pelletizing the oxidic material powder of a fineness insufficient to form coherent briquettes suitable for feeding to a blast furnace into substantially spherical pellets having an average diameter of from 2 to 10 millimeters by passing the oxidic material through a rotating heated pelletizing kiln at a temperature of from 900° to 1300°C; and b. cooling the pellets to a temperature of from 500° to 800°C prior to the briquetting step.

* * * * *